US005797761A

United States Patent [19]

Ring

[11] Patent Number: 5,797,761

[45] Date of Patent: Aug. 25, 1998

[54] POWER CONNECTOR ASSEMBLY

[75] Inventor: Russell K. Ring, Friendswood, Tex.

[73] Assignee: Kemlon Products & Development Company, Houston, Tex.

[21] Appl. No.: 641,253

[22] Filed: Apr. 30, 1996

[51] Int. Cl.[6] ..... H01R 4/38

[52] U.S. Cl. ..... 439/320; 439/589

[58] Field of Search ..... 439/589, 281, 439/320, 367

[56] References Cited

U.S. PATENT DOCUMENTS

| | | | |
|---|---|---|---|
| 2,563,712 | 8/1951 | Frei et al. | 439/589 |
| 2,563,762 | 8/1951 | Uline et al. | 439/589 |
| 3,040,287 | 6/1962 | Agron et al. | 439/589 |
| 3,125,395 | 3/1964 | Swanson | 439/589 |
| 3,158,680 | 11/1964 | Lovitt et al. | 439/589 |
| 3,172,721 | 3/1965 | Kelly | 439/589 |

*Primary Examiner*—Hien Vu

*Attorney, Agent, or Firm*—Wendy K. Buskop; Chamberlain, Hrdlicka et al

[57] ABSTRACT

In one embodiment of the present invention, there is provided a female power connector for connecting to a power cable. The power connector is designed to couple a male surface connector to a downhole pumping system. The power connector has a substantially cylindrical piece of pre-molded insulating material, a substantially tubular bushing designed to engage a coupling nut, a coupling nut for engaging a surface connector, and a sleeve. The cylindrical piece has a longitudinal axis, an outside surface defining an outside diameter, a first end, a second end, and a means for creating a fluid tight barrier adjacent to the second end. The cylindrical piece further defines a plurality of substantially circular cavities extending from the first end to the second end parallel to the longitudinal axis. Each channel has an inside surface defining an inside diameter. The bushing engages the coupling nut and the sleeve when the secondary molding is in place. In another embodiment, there is provided a method for connecting a power connector to a power cable.

23 Claims, 5 Drawing Sheets

POWER CONNECTOR ASSEMBLY

BACKGROUND OF THE INVENTION

This invention relates to electrical cable termination and a method of connecting a power connector to a power cable.

In oil field operations it is common practice to produce oil from wells by down hole pumps that are activated by electric motors adjacent the bottom of the well. Such motors are supplied with electric power by cables that extend downwardly in the wells from the ground surface, and the cables having terminations that are removably, connected to the motors. Several different cable connectors have been designed to endure the hostile conditions associated with the bottom of an oil well.

Some lower cable connectors comprise a molded pigtail which is made by vulcanizing a piece of cable directly to the connector. The pigtail is then spliced to the pump cable. This type of connector is prepared in the factory and used in the field to splice the new connector to the cable. Because the cable piece is vulcanized to the connector there are temperature limitations on the vulcanization process. A lower connector having a pre-molded insulated piece that can be vulcanized at higher temperatures using higher quality materials and attached directly to a cable, would be highly desirable.

A lower connector having a pre-molded insulated piece as described provides other advantages in addition to the higher quality materials used. The lower connector and inserts can be sold together as a kit to be sold by cable repair companies. The cables can then be repaired on site easily and quickly with a lower chance of failure.

OBJECTS OF THE INVENTION

It is an object of the present invention to provide a cable connector that may be directly attached to a cable avoiding a splice.

It is another object of the present invention to provide a cable connector with a thermally and chemically superior primary insulation around the electrical contacts.

It is a further object of the present invention to provide a method for directly connecting a cable connector to a cable without a splice.

SUMMARY OF THE INVENTION

In one embodiment of the present invention, there is provided a female power connector for connecting to a power cable. The power connector is designed to couple a male surface connector to a downhole pumping system. The power connector comprises a substantially cylindrical piece of pre-molded insulating material, a substantially tubular bushing designed to engage a coupling nut, a coupling nut for engaging a surface connector, and a sleeve. The cylindrical piece has a longitudinal axis, an outside surface defining an outside diameter, a first end, a second end, and a means for creating a fluid tight barrier adjacent to the second end. The cylindrical piece further defines a plurality of substantially circular channels extending from the first end to the second end parallel to the longitudinal axis. Each channel has an inside surface defining an inside diameter.

The substantially tubular bushing has a longitudinal axis, with an inside surface, a first end, a second end. The bushing has a first outside surface adjacent to the first end that defines a first outside diameter, a second outside surface adjacent to the first outside surface that defines a second outside diameter. The second outside diameter is greater than the first outside diameter. The bushing has a third outside surface adjacent to the second outside surface that defines a third outside diameter. The third outside diameter is lesser than the second outside diameter. The third outside surface has a means for attaching a sleeve to the bushing. The bushing further has a fourth outside surface adjacent to the third outside surface that defines a fourth outside diameter which is lesser than the third outside diameter. The junction between the third outside surface and the fourth outside surface forms a shoulder that acts as a stop for the metal sleeve. The inside surface of the bushing is bonded to and in a covering relationship to the outside surface of the cylindrical piece between the first end and the second end of the cylindrical piece.

The substantially tubular coupling nut has a longitudinal axis, an inside surface, an outside surface, a first end, and a second end. The inside surface has threads near the first end for engaging a surface connector. The inside surface near the second end is adjacent to and in covering relationship to the first outside surface of the bushing near the first end of the bushing. The cylindrical piece has a means for engaging the surface connector in an alignable manner.

The substantially tubular sleeve has a longitudinal axis, a first end, a second end, an inside surface, and an outside surface. The inside surface at the first end has a means for attaching the sleeve to the third outside surface of the bushing. When the sleeve is attached to the bushing, the sleeve is in covering relationship to the cylindrical piece near the second end of the cylindrical piece and the bushing near the second end of the bushing. The longitudinal axes of the cylindrical piece, the bushing, the coupling nut and the sleeve are coaxial.

In another embodiment, there is provided a method for connecting a power connector to a power cable. The method comprises providing a power connector, a piece of cable, and a cable follower. The power connector has a cylindrical piece of pre-molded insulating material, a substantially tubular bushing, a substantially tubular coupling nut, and a substantially tubular sleeve. The cylindrical piece can be made of a high dielectric material such as a fluoroelastomer.

The cylindrical piece defines a plurality of substantially circular cavities. The bushing has an inside surface, and an outside surface where the outside surface has a means for attaching to a sleeve. The inside surface of the bushing is bonded to and in covering relationship to the outside surface of the cylindrical piece. The coupling nut has an inside surface and an outside surface, the inside surface has threads. The tubular sleeve has an inside surface containing a means for attaching a bushing compatible with the outside surface of the bushing. The cable follower is sized to be received by the tubular sleeve.

A piece of power cable is prepared by removing a portion of the outer sheath and insulating material to expose the cable wires. The cable follower is positioned over the cable. A plurality of inserts are attached to the prepared piece of power cable. The inserts have electrical contacts positioned within the insert. The inserts are pulled into the cavities of the cylindrical piece and locked in position via a locking means to form a connector-cable connection. The inserts may be locked in position using a snap-ring. The connector and the cable are then primed with a layer of bonding material. The connector-cable connection is then coaxially sealed by molding or preferably vulcanizing in situ. The sleeve then slides over the sealed connector-cable connection and is attached to the bushing.

DETAILED DESCRIPTION OF THE PREFERRED EMBODIMENTS

Figure 1:
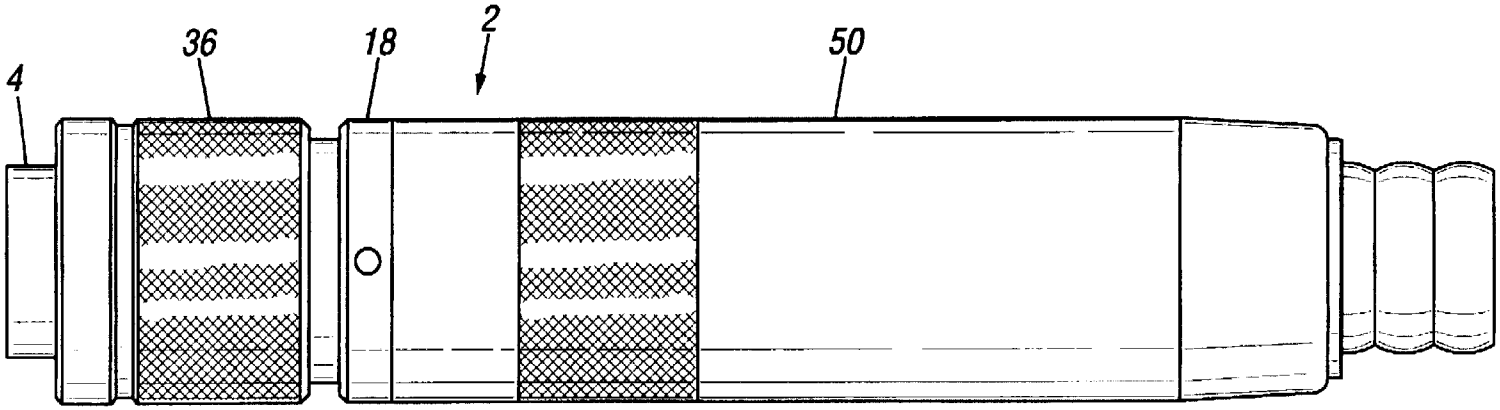
FIG. 1 is a pictorial view of the connector with the cable in place.
Figure 1A:
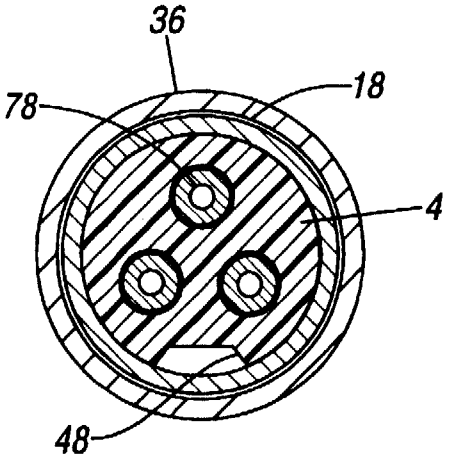
FIG. 1*a* is and end view of the connector where the male connector is inserted.
Figure 2:
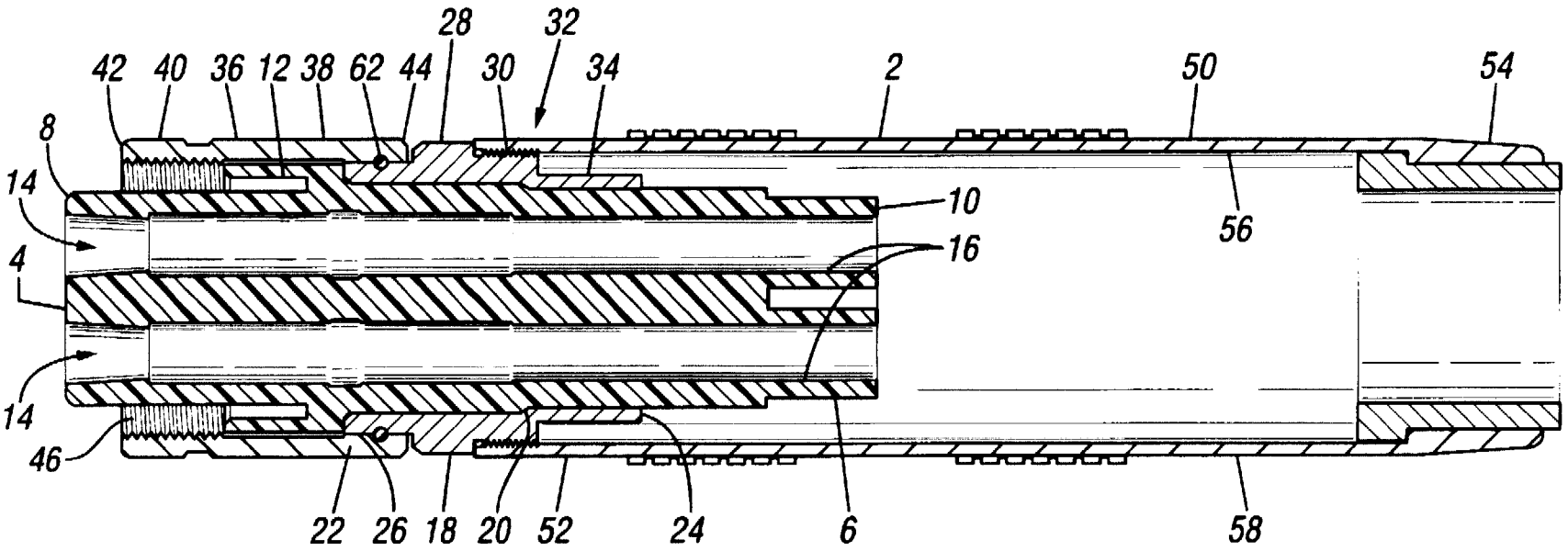
FIG. 2 is a cross-sectional view of the connector without the cable in place.

In one embodiment of the present invention, there is provided a female power connector 2 for connecting to a power cable. The power connector 2 comprises a substantially cylindrical piece 4 of pre-molded insulating material, a substantially tubular bushing 18 designed to engage a coupling nut, a coupling nut 36 for engaging a surface connector (not shown), and a sleeve 50 as shown in FIGS. 1 and 2. The cylindrical piece 4 has a longitudinal axis, an outside surface 6 defining an outside diameter, a first end 8, a second end 10, and a means for creating a fluid tight barrier 12 adjacent to the first end 8. The means for creating a fluid tight barrier 12 can be a lip seal or an o-ring used to keep gas or moisture from entering the connector. The cylindrical piece 4 further defines a plurality of substantially circular channels 14 extending from the first end 8 to the second end 10 parallel to the longitudinal axis. Each channel 14 has an inside surface 16 defining an inside diameter. The cylindrical piece 4 has a means 48 for engaging the surface connector in an alignable manner, such as an alignment key shown in FIG. 1*a*.

In a preferred embodiment, the cylindrical piece 4 is made of an elastomeric material. The elastomeric material is chemically resistant, has a post cure temperature capable of causing damage to the cable, and is able to withstand pressure that would otherwise damage the cable jacket. The elastomeric material also has gas resistance superior to the low temperature compounds available for direct vulcanization to the cable. The elastomeric material can be a fluorocarbon rubber or a mixture of fluorocarbon rubber and related elastomers. The elastomeric material may also comprise a composite using fluorocarbon rubber. The cylindrical piece 4 can have a post cure temperature of between 350 and 450 degrees Fahrenheit.

The substantially tubular bushing 18 has a longitudinal axis, with an inside surface 20, a first end 22, a second end 24. (See FIG. 2) The bushing 18 has a first outside surface 26 adjacent to the first end 22 that defines a first outside diameter, a second outside surface 28 adjacent to the first outside surface 26 that defines a second outside diameter. The second outside diameter is greater than the first outside diameter. The bushing 18 has a third outside surface 30 adjacent to the second outside surface 28 that defines a third outside diameter. The third outside diameter is lesser than the second outside diameter. The third outside surface 30 has a means for attaching 32 a sleeve 50 to the bushing 18. The bushing 18 further has a fourth outside surface 34 adjacent to the third outside surface that defines a fourth outside diameter which is lesser than the third outside diameter. The inside surface 20 of the bushing 18 is bonded to and in a covering relationship to the outside surface 6 of the cylindrical piece 4 between the first end 8 and the second end 10 of the cylindrical piece 4.

The substantially tubular coupling nut 36 has a longitudinal axis, an inside surface 38, an outside surface 40, a first end 42, and a second end 44. (See FIG. 2) The inside surface 38 has threads 46 near the first end for engaging a male surface connector. The inside surface 38 near the second end 44 is adjacent to and in covering relationship to the first outside surface 26 of the bushing 18 near the first end 22 of the bushing 18. Preferably, a snap ring 62 is positioned between the inside surface 38 of the coupling nut 36 and the first outside surface 26 of the bushing 18 to hold the coupling nut 36 in place.

Figure 3:
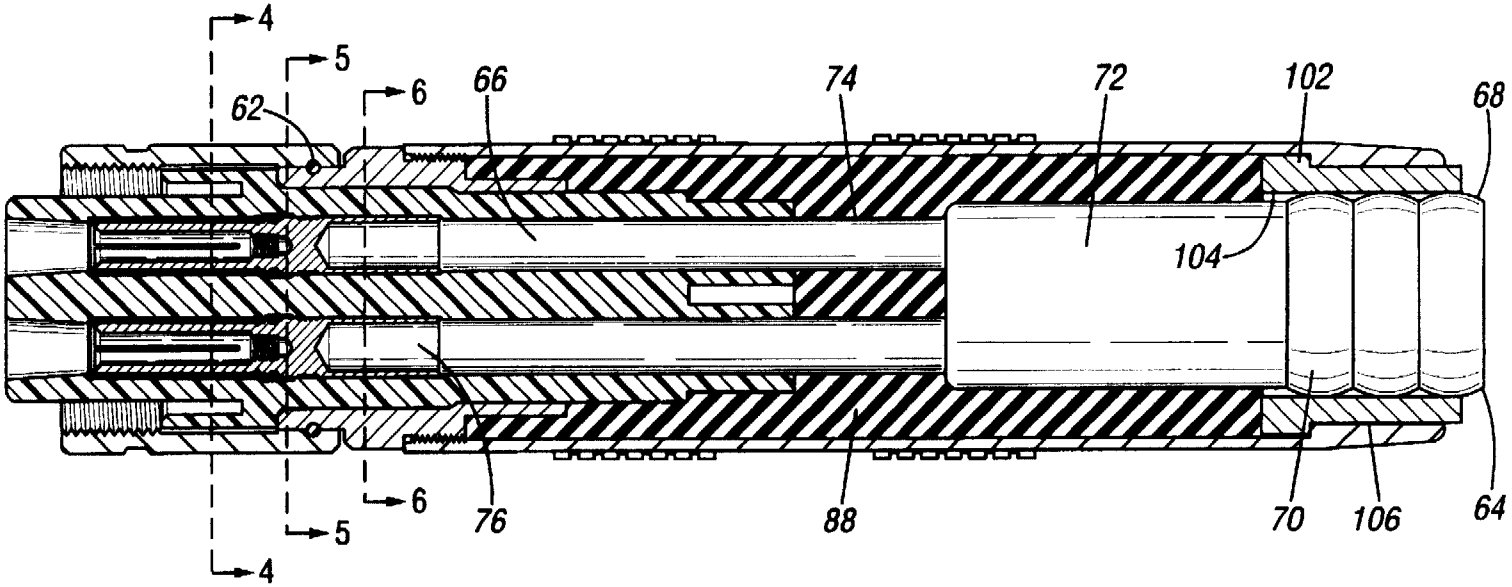
FIG. 3 is a cross-sectional view of the connector with the cable in place.
Figure 6:
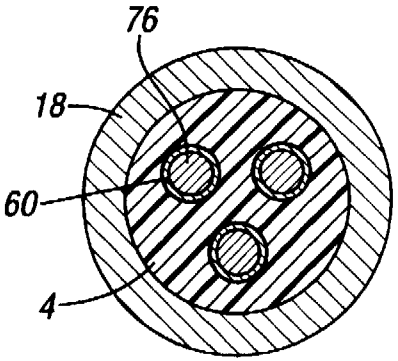
FIG. 6 is a view along the cut line 6—6.
Figure 5:
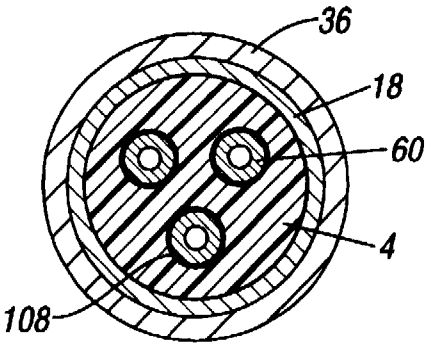
FIG. 5 is a view along the cut line 5—5.
Figure 4:
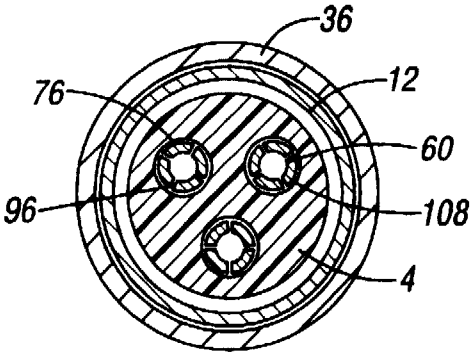
FIG. 4 view along the cut line 4—4.

The substantially tubular sleeve 50 has a longitudinal axis, a first end 52, a second end 54, an inside surface 56, and an outside surface 58. (See FIG. 2) The inside surface 56 at the first end 52 has a means 32 for attaching the sleeve 50 to the third outside 30 surface of the bushing 18 such as a snap ring, threads, adhesive, pins, or spring action pins. When the sleeve 50 is attached to the bushing 18, the sleeve 50 is in covering relationship to the cylindrical piece 4 near the second end 10 of the cylindrical piece 4 and the bushing 18 near the second end 24 of the bushing 18. The longitudinal axes of the cylindrical piece 4, the bushing 18, the coupling nut 36 and the sleeve 50 are coaxial. Preferably, the bushing 18, the coupling nut 36 and the sleeve 50 are coated with cadmium to resist corrosion when a lower quality steel alloy is used. Preferably, a cable follower 102 is positioned on the second end 54 of the sleeve 50 as shown in FIG. 3. The cable follower 102 has an inside surface 104 defining an inside diameter and an outside surface 106 defining an outside diameter. The outside diameter of the cable follower 102 is substantially similar to the inside diameter of the sleeve 50 and the inside diameter of the cable follower can be adapted to different size cables. Preferably, the inside diameter of the cable follower 102 is substantially similar to the outside diameter of the selected cable to resist swelling of the cable.

Figure 7:
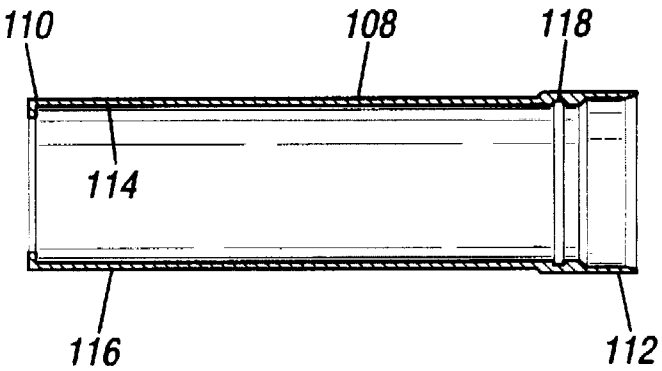
FIG. 7 is a cross-sectional view of a sleeve.
Figure 8:
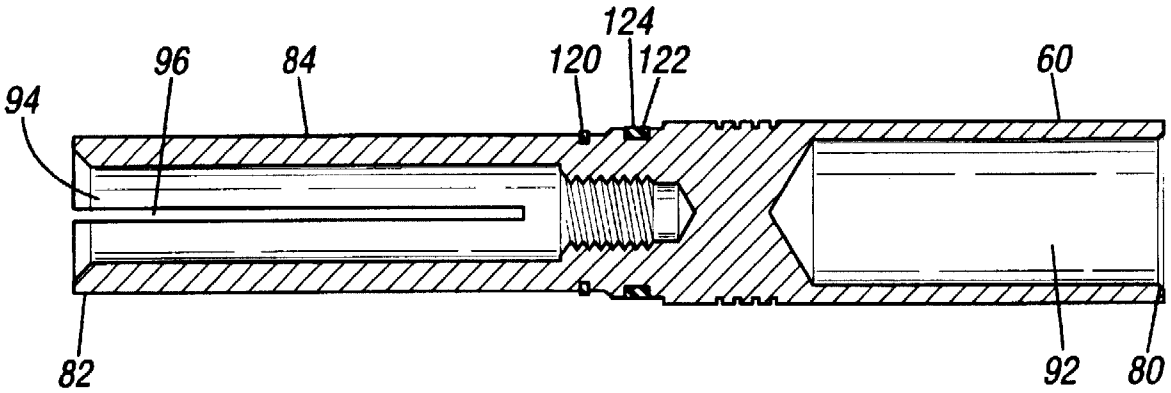
FIG. 8 is a cross-sectional view of an insert without a sleeve.

In a preferred embodiment, the cylindrical piece 4 has a means for engagably locking an insert disposed within each of said plurality of substantially circular channels near the second end of the cylindrical piece as shown in FIG. 7. The means for engagably locking an insert comprises a sleeve 108. In this embodiment, the inserts 60 have a first end 80 and a second end 82. The first end 80 defines a first cavity 92 for receiving an insulated cable wire. (See FIG. 8). The second end 82 defines a second cavity 94. Each insert 60 is made of a high conductivity material. The inserts have an outside surface 84 defining an outside diameter substantially similar to the inside diameter of each channel 14 in said cylindrical piece 4. Each insert 60 also as a set of electrical contact fingers 86 defined by the second cavity 94. The electrical contact fingers 86 are positioned adjacent to the first end 8 of the cylindrical piece 4. Each insert 60 is closely received by a corresponding channel 14 within the cylindrical piece 4. (See FIG. 3)

Preferably, the sleeve 108 has a longitudinal axis, a first end 110, a second end 112, an inner surface 114 defining an inner diameter and an outer surface 116 defining an outer diameter as shown in FIG. 7. The outer surface 116 is bonded to the inner surface of each channel 14. The inner surface 114 of the sleeve 108 defines a groove 118 for receiving a snap ring. The groove 118 is positioned near the second end 112 of the sleeve 108. Each insert 60 further defines a groove 122 for receiving an o-ring 124. In this embodiment, the insert 60 defines a groove for receiving the snap ring 120. The snap ring 120 snaps into groove 118 while the o-ring 124 seals the entire electrical contact member to prevent water or moisture from reaching the face of the electrical contact between the male and female contacts.

In a preferred embodiment, the cable 64 has a first end 66 and a second end 68, an outer surface 70 covering an outer insulating cable jacket 72 which in turn covers an inner insulating wire jacket 74. The first end 66 has a plurality of exposed cable wires 76 as shown in FIG. 3. The exposed cable wires are the conductor portion of the cable wires. Preferably, there is a cable follower 102 as described above where the inside diameter of the cable follower 102 is large enough to accommodate the second end 68 of the cable 64. The cable follower 102 is used so that different size cables may be used without having to change the inside diameter of the metal sleeve 50.

Figure 9:
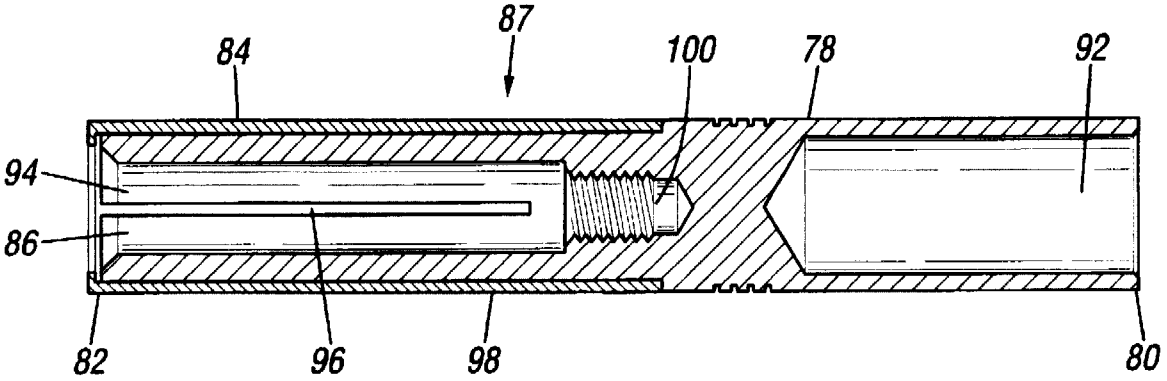
FIG. 9 is a cross-sectional view of an insert with a sleeve.
Figure 10:
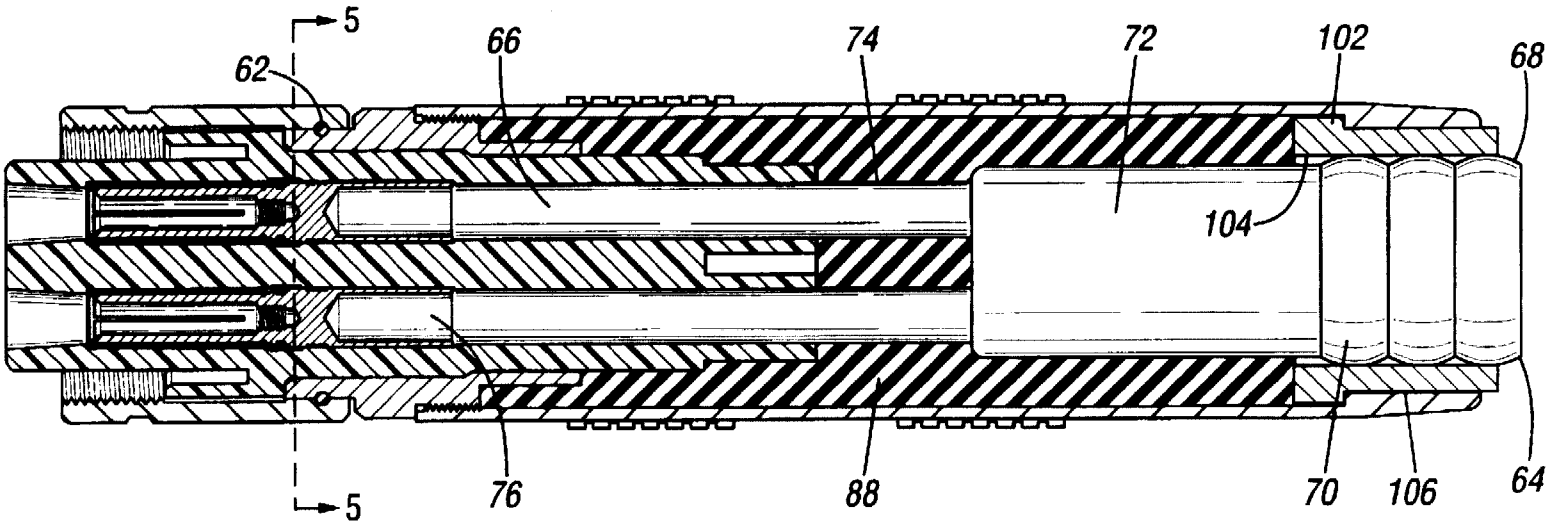
FIG. 10 is a cross-sectional view of the connector.

In another preferred embodiment, there are a plurality of inserts 78, where each of said plurality of inserts 78 has a first end 80 and a second end 82 as shown in FIG. 9. The first end 80 defines a first cavity 92 for receiving an insulated cable wire as described previously. The second end 82 defines a second cavity 94. Each insert 78 is made of a high conductivity material. The inserts have an outside surface 84 defining an outside diameter substantially similar to the inside diameter of each channel 14 in said cylindrical piece 4. Each insert 78 also as a set of electrical contact fingers 86 defined by the second cavity 94. (See FIG. 9) The electrical contact fingers 86 are positioned adjacent to the first end 8 of the cylindrical piece 4. The first end 80 is attached to one of the plurality of cable wires 76. Each insert 78 is positioned inside a channel 14 such that an inside surface 16 of a channel is closely adjacent, preferably intimately contacted, to an outside surface 84 of an insert 78. A secondary molded rubber piece 88 is positioned between the sleeve 50 and the cable 64 and the sleeve 50 and the cylindrical piece 4. The secondary molded rubber piece 88 is vulcanized in situ.

Preferably, the insert 78 is surrounded by a protective sleeve 98 as shown in FIG. 9. Preferably, when a plurality of contacts from a male connector are inserted into the connector 2, they are compressibly received by the contact fingers 86 of each contact assembly 87. The protective sleeve 98 is in covering relationship to the outside surface 84 and the first end 82 of the insert 78. The protective sleeve 98 keeps the cylindrical piece 4 from pressing into the slots 96. A means 100 for engaging an insert comprising threads is positioned in the first cavity 92 near the first end 80 of the insert 78. The second cavity 94 is sized to closely receive the exposed cable wire 76. The inserts may be made of a high conductivity material such as copper, oxygen free copper or trillium copper or a suitable mixture thereof. The inserts 78 and 60 can be plated with gold, a gold mixture, or similar conducting material, to resist corrosion and improve the electrical connection.

In another embodiment, there is provided a method for connecting a power connector 2 to a power cable. The method comprises providing a power connector 2, a piece of cable, and a cable follower 102. The power connector 2 has a cylindrical piece 4 of pre-molded insulating material, a substantially tubular bushing 18, a substantially tubular coupling nut 36, and a substantially tubular sleeve 50. The cylindrical piece 4 can be made of a high dielectric material such as a fluoroelastomer. The cylindrical piece 4 defines a plurality of substantially circular cavities 14. The bushing 18 has an inside surface 20 and an outside surface 30 where the outside surface has a means for attaching to a sleeve 50. The inside surface 20 is bonded to and in covering relationship to the outside surface 6 of the cylindrical piece 4. The coupling nut 36 has an inside surface 38 and an outside surface 40, the inside surface 38 has threads. The tubular sleeve 50 has an inside surface 56 containing a means 32 for attaching a bushing compatible with the outside surface of the bushing 18. The cable follower 102 is sized to receive the cable 64 and be received by the tubular sleeve 50.

A piece of power cable is prepared by removing a portion of the outer sheath and insulating material to expose the cable wires 76. The cable follower 102 is positioned over the cable 68. A plurality of inserts 60 are attached to the prepared piece of power cable. The inserts 60 are pulled into the cavities 14 of the cylindrical piece 4 and held in position to form a connector-cable connection. The inserts 60 may be locked in position using a sleeve 108 bonded to the inner surface of the channel 14 and snap-ring 120 as described above. The insert 60 can have a snap-ring 120 mounted on the outer surface that engages the groove 118 in the sleeve 108 when the insert is pulled into the channel 14. The insert 60 is then held securely in place for the next step. The connector 2 and the cable 64 are then primed with a layer of bonding material. The connector-cable connection is then sealed by molding or preferably vulcanizing in situ. The sleeve 50 then slides over the sealed connector-cable connection and is attached to the bushing 18. Any conventional vulcanizable material can be used for the secondary molding.

In an alternative embodiment, as shown in FIG. 9, the sleeve 98 can be bonded to an insert 78 were the insert 78 is secured via a means 100 for engaging an insert. The means 100 for engaging the insert can be threads. The insert 78 is attached to the cable and pulled into the channel 14 much like the previous method. The insert 78 plus cable are held in place via the means for engaging the insert and the secondary molding is done as described above.

As described previously, the cylindrical piece 4 comprises an elastomeric material. The elastomeric material is chemically resistant, has a post cure temperature capable of causing damage to the cable, and is able to withstand pressure that would otherwise damage the cable jacket.

Although the present invention is described and illustrated above with detailed reference to the preferred embodiment, the invention is not limited to the details of such embodiment but is capable of numerous modifications, by one of ordinary skill in the art, within the scope of the following claims.

What is claimed is:

1. A power connector for a power cable comprising:

a substantially cylindrical piece of pre-molded insulating material, said cylindrical piece having a longitudinal axis, an outside surface defining an outside diameter, a first end, a second end, and a means for creating a fluid tight barrier adjacent to the second end, said cylindrical piece further defining a plurality of substantially circular cavities extending from the first end to the second end parallel to the longitudinal axis, each said channel having an inside surface defining an inside diameter;

a substantially tubular bushing for engaging a coupling nut, said busing having a longitudinal axis, with an inside surface, a first end, a second end, a first outside surface adjacent to the first end and defining a first outside diameter, a second outside surface adjacent to the first outside surface and defining a second outside diameter, wherein said second outside diameter is greater than the first outside diameter, a third outside surface adjacent to the second outside surface and defining a third outside diameter, wherein said third outside diameter is lesser than the second outside diameter, said third outside surface having a means for attaching a sleeve to the bushing, and a fourth outside surface adjacent to the third outside surface and defining a fourth outside diameter which is lesser than the third outside diameter, said inside surface being bonded to and in a covering relationship to the outside surface of the cylindrical piece between the first end and the second end of the cylindrical piece;

a substantially tubular coupling nut for engaging a surface connector having an inside surface, an outside surface, a first end, a second end and a longitudinal axis, said inside surface containing threads near the first end, said inside surface near the second end being adjacent to and in covering relationship to the first outside surface of the bushing near the first end of the bushing, said cylindrical piece having a means for engaging the surface connector in an alignable manner;

a snap ring positioned between the inside surface of the coupling nut and the first outside surface of the bushing;

a substantially tubular sleeve having a first end, a second end, an inside surface, an outside surface and a longitudinal axis, said inside surface at the first end having a means for attaching to the third outside surface of the bushing, said sleeve in covering relationship to the cylindrical piece near the second end of the cylindrical piece and the bushing near the second end of the bushing;

wherein the longitudinal axes of said cylindrical piece, said bushing, said coupling nut and said sleeve are coaxial.

2. The power connector of claim 1, wherein the means for attaching the sleeve to the bushing is threads.

3. The power connector of claim 1, wherein the means for creating a fluid tight barrier comprises a lip seal.

4. The power connector of claim 1, wherein the means for creating a fluid tight barrier comprises an o-ring.

5. The power connector of claim 1, further comprising a means for engagably locking an insert disposed within each of said plurality of substantially circular cavities near the second end of the cylindrical piece.

6. The power connector of claim 5, wherein the means for engagably locking an insert comprises a sleeve.

7. The power connector of claim 6, further comprising a plurality of inserts each of said plurality of inserts having a first end and a second end, said first end defining a first cavity for receiving an insulated cable wire, said second end defining a second cavity, each said insert being made of a high conductivity material, said inserts having an outside surface defining an outside diameter substantially similar to the inside diameter of each channel in said cylindrical piece, each said insert further comprising a set of circular electrical contact fingers defined by said second cavity, said electrical contact fingers being positioned adjacent to the first end of the cylindrical piece, wherein each insert is closely received by a corresponding channel within the cylindrical piece.

8. The power connector of claim 6, wherein said sleeve comprises a longitudinal axis, a first end, a second end, an inner surface defining an inner diameter and an outer surface defining an outer diameter, wherein the outer surface is bonded to the inner surface of each said channel, the inner surface of said sleeve defining a groove for receiving a snap ring, said groove being positioned near the second end of the sleeve.

9. The power connector of claim 7, wherein each of said plurality of inserts define a groove for receiving an o-ring.

10. The power connector of claim 1, wherein the cylindrical piece is made of an elastomeric material said elastomeric material being chemically resistant, said elastomeric material further having a post cure temperature capable of causing damage to the cable, said elastomeric material being able to withstand pressure that would otherwise damage the cable jacket.

11. The power connector of claim 10, wherein the elastomeric material comprises a fluorocarbon rubber.

12. The power connector of claim 10, wherein the elastomeric material comprises a mixture of fluorocarbon rubber and related elastomers.

13. The power connector of claim 10, wherein the elastomeric material comprises a composite having fluorocarbon rubber.

14. The power connector claim 2, wherein the cylindrical piece has a post cure temperature of between 350 and 450 degrees Fahrenheit.

15. The power connector of claim 1, wherein the bushing, the coupling nut and the sleeve are coated with cadmium.

16. The power connector of claim 2, further comprising a cable having, a first end and a second end, an outer surface and an inner surface, and a jacket surrounding the outer surface, wherein said first end comprises a plurality of exposed insulated cable wires;

a plurality of inserts, each of said inserts having a first end and a second end, said first end defining a first cavity for receiving each of said plurality of insulated cable wires, said second end defining a second cavity, each said insert being made of a high conductivity material, said inserts having an outside surface defining an outside diameter substantially similar to the inside diameter of each channel in said cylindrical piece, each said insert further comprising a set of circular electrical contact fingers defined by said second cavity, wherein each insert is closely received by a corresponding channel within the cylindrical piece, said electrical contact fingers being positioned adjacent to the first end of the cylindrical piece; and a secondary molded rubber piece positioned between the sleeve and the cable and the sleeve and the cylindrical piece, said secondary molded rubber piece being vulcanized in situ.

17. The power connector of claim 16, wherein the inside surface of the channel which is closely received by the outside surface of the insert is intimately contacted to the outside surface of the insert.

18. The power connector of claim 16, wherein the high conductivity material is selected from the group consisting of copper, oxygen free copper, and trillium copper.

19. The power connector of claim 16, wherein the second cavity further comprises a longitudinal axis, a first end, a second end, an inside surface defining an inside diameter, said inside surface further defining slots positioned parallel to the longitudinal axis of the second cavity, and a means for engaging the insert comprising threads positioned between the first end and the second end of the insert.

20. The power connector of claim 17, wherein the insert is plated with gold.

21. The power connector of claim 17, wherein the insert is plated with a gold mixture.

22. The power connector of claim 19, wherein a contact from a male connector is inserted into the contact assembly in a compression relationship with the inside diameter of the contact assembly.

23. The power connector of claim 1, further comprising a cable follower having an inside surface defining an inside diameter and an outside surface defining an outside diameter, wherein the outside diameter is substantially similar to the inside diameter of the sleeve.

* * * * *